US008376176B2

(12) United States Patent
Dengel et al.

(10) Patent No.: US 8,376,176 B2
(45) **Date of Patent: *Feb. 19, 2013**

(54) CONTAINER HAVING A FLANGE WITH A PIVOTABLE TAB INDICATING TAMPER EVIDENCE

(75) Inventors: Gustav Dengel, Gummersbach (DE); Frank Diesterbeck, Marienheide (DE); Robert Guido Georgiadis, Bergisch Gladbach (DE); Marcus Blumenschein, Marienheide (DE)

(73) Assignee: Jokey Plastik Gummersbach GmbH, Gummersbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/795,860

(22) Filed: Jun. 8, 2010

(65) Prior Publication Data

US 2010/0243654 A1 Sep. 30, 2010

Related U.S. Application Data

(63) Continuation of application No. 10/507,398, filed as application No. PCT/DE03/00744 on Mar. 6, 2003, now Pat. No. 7,731,049.

(30) Foreign Application Priority Data

Mar. 11, 2002 (DE) ..... 102 10 486

(51) Int. Cl.
*B65D 43/08* (2006.01)
*B65D 43/10* (2006.01)

(52) U.S. Cl. ..... 220/284; 215/47; 215/49; 220/285

(58) Field of Classification Search ..... 215/47–49; 220/281, 284–286, 324–326, 784, 786, 788
See application file for complete search history.

(56) References Cited

U.S. PATENT DOCUMENTS

| | | | | | |
|---|---|---|---|---|---|
| 2,013,605 | A | * | 9/1935 | Greenison | 215/252 |
| 2,695,806 | A | * | 11/1954 | Balint | 292/258 |
| 2,837,263 | A | * | 6/1958 | Nasello | 229/125.19 |
| 3,347,409 | A | * | 10/1967 | Burns | 220/784 |
| 3,352,479 | A | * | 11/1967 | Mohs | 229/123.2 |
| 3,688,942 | A | * | 9/1972 | Mitchell et al. | 220/784 |
| 3,716,162 | A | * | 2/1973 | Botkin | 215/316 |
| 3,753,512 | A | * | 8/1973 | Curry | 220/260 |
| 3,759,415 | A | * | 9/1973 | Cloyd | 220/784 |

(Continued)

FOREIGN PATENT DOCUMENTS

| | | | |
|---|---|---|---|
| DE | 20119701 | U1 * | 12/2002 |
| DE | 10140255 | A1 * | 2/2003 |

(Continued)

*Primary Examiner* — J. Gregory Pickett
*Assistant Examiner* — Ned A Walker
(74) *Attorney, Agent, or Firm* — Grossman Tucker Perreault & Pfleger, PLLC

(57) ABSTRACT

A container, especially a bucket or similar, comprising an opening, which is orientated upwards and which can be closed by a cover, and a peripheral container edge, which is drawn outwards in a downward direction on the container wall, where the cover is detachably connected thereto and whereon at least one pivotal tab is connected in such a way that at least one part of the cover is raised due to a pivoting movement away from a starting position on the container wall, and engages with the container edge from behind with part of the pivotal tab which can be guided outwards by the pivoting movement to a position in front of the container wall and the part of the pivotal tab is prevented from being guided behind the container edge when the pivotal tab pivots back in the direction of the initial position.

12 Claims, 5 Drawing Sheets

U.S. PATENT DOCUMENTS

| | | | | | |
|---|---|---|---|---|---|
| 3,811,597 | A | * | 5/1974 | Frankenberg et al. | 220/284 |
| 3,840,152 | A | * | 10/1974 | Hodge | 220/783 |
| 3,841,512 | A | * | 10/1974 | Botkin | 215/365 |
| 3,858,748 | A | * | 1/1975 | Marco | 220/276 |
| 3,999,677 | A | * | 12/1976 | Oberkircher | 220/266 |
| 4,119,239 | A | * | 10/1978 | Anderson | 220/324 |
| 4,245,753 | A | * | 1/1981 | Ellis | 220/288 |
| 4,687,112 | A | * | 8/1987 | Swartzbaugh | 215/216 |
| 4,730,745 | A | * | 3/1988 | Perry | 215/230 |
| 4,787,530 | A | * | 11/1988 | Edwards | 220/266 |
| 4,905,861 | A | * | 3/1990 | Boxall et al. | 220/266 |
| 4,915,913 | A | * | 4/1990 | Williams et al. | 422/119 |
| 4,966,302 | A | * | 10/1990 | Hjordie | 220/268 |
| 5,111,954 | A | * | 5/1992 | Gaudreault | 220/266 |
| 5,170,905 | A | * | 12/1992 | Luch | 220/276 |
| 5,219,087 | A | * | 6/1993 | Christensson | 220/270 |
| 5,234,124 | A | * | 8/1993 | Buckner et al. | 220/326 |
| 5,307,948 | A | * | 5/1994 | Blackburn et al. | 220/269 |
| 5,348,185 | A | * | 9/1994 | Buckner et al. | 220/326 |
| 5,538,154 | A | * | 7/1996 | Von Holdt | 220/277 |
| 5,816,422 | A | * | 10/1998 | Roig | 215/209 |
| 5,893,480 | A | * | 4/1999 | Dore et al. | 220/784 |
| 5,931,332 | A | * | 8/1999 | Mygatt et al. | 220/270 |
| 5,960,979 | A | * | 10/1999 | Van Den Brink et al. | 220/266 |
| 5,979,681 | A | * | 11/1999 | Varlet et al. | 215/216 |
| 5,979,691 | A | * | 11/1999 | Von Holdt | 220/266 |
| 6,269,967 | B1 | * | 8/2001 | de Vries | 220/669 |
| 6,318,585 | B1 | * | 11/2001 | Asagiri et al. | 220/788 |
| 6,328,355 | B1 | * | 12/2001 | Bortz | 292/307 R |
| 6,644,492 | B1 | * | 11/2003 | Mitchell | 220/285 |
| 6,793,096 | B1 | * | 9/2004 | Seok | 220/788 |
| 6,866,162 | B2 | * | 3/2005 | Morris, Sr. | 220/288 |
| 7,159,733 | B2 | * | 1/2007 | Pickles | 220/324 |
| 7,438,198 | B2 | * | 10/2008 | Pickles | 220/324 |
| 7,475,789 | B2 | * | 1/2009 | Fischer | 220/285 |
| 7,731,049 | B2 | * | 6/2010 | Dengel et al. | 220/284 |
| 2003/0085227 | A1 | * | 5/2003 | Azzarello | 220/266 |
| 2004/0050849 | A1 | * | 3/2004 | Pickles | 220/324 |
| 2004/0089668 | A1 | * | 5/2004 | Lambelet, Jr. | 220/835 |
| 2004/0195241 | A1 | * | 10/2004 | Stull et al. | 220/326 |
| 2006/0201947 | A1 | * | 9/2006 | Pickles | 220/326 |

FOREIGN PATENT DOCUMENTS

| | | | | |
|---|---|---|---|---|
| EP | 565967 | A1 | * | 10/1993 |
| EP | 1052183 | A1 | * | 11/2000 |
| EP | 1122184 | A1 | * | 8/2001 |
| EP | 1724202 | A1 | * | 11/2006 |
| FR | 2818248 | A1 | * | 6/2002 |
| WO | WO 03076287 | A1 | * | 9/2003 |

* cited by examiner

CONTAINER HAVING A FLANGE WITH A PIVOTABLE TAB INDICATING TAMPER EVIDENCE

CROSS-REFERENCE TO RELATED APPLICATIONS

This application is a continuation application of U.S. application Ser. No. 10/507,398 filed Aug. 24, 2005 which is a U.S. National Stage Completion of PCT/DE03/00744 filed on Mar. 6, 2003 which claims priority to German Application No. DE 102 10 486.7 filed on Mar. 11, 2002.

FIELD

The invention relates to a container, especially a bucket or similar, comprising an opening, which is orientated upwards and which can be closed by a cover, and a peripheral container edge, which is drawn outwards in a downward direction on the container wall, where the cover is detachably connected thereto and whereon at least one tongue-like element is connected in such a way that at least one part of the cover is raised due to a pivoting movement away from a starting position on the container wall.

BACKGROUND

Containers or vessels of this kind, which can be manufactured from elastic plastic materials by the injection moulding method, in particular, are widely used because of their inexpensive manufacture and their low weight. They are eminently suited to the stocking, storage and transport of pourable goods in liquid or also granulated form in handy packagings, without having to accept major restrictions as regards weight or shape as a result of the container itself. Moreover, the contents of the container need not be consumed in a single operation, as the container can be re-sealed with a cover, meaning that the contents can still be used after opening the container once or several times.

However, this initially highly positive feature entails the disadvantage that, as a result, the container must in some way be provided with an indication for the user or buyer to show whether or not an opening procedure has already taken place at some time; in other words, the intactness or original condition of the container should preferably be apparent even at only a fleeting glance.

In general, the removal of a cover from a container is facilitated by raising an area of the cover, for which purpose an aid of the nature of a tongue-like element is used, such as known from U.S. Pat. No. 3,753,512, for example.

A container of the kind mentioned in the opening paragraph is known, for example, from EP 0 565 967 B2, which describes a container to whose container edge a tongue-like element is connected that raises the cover as a result of a pivoting movement away from a starting position. In this context, at least one of the face edges of the ends of a fastening flange is supposed to be connected to the associated edge of the tongue-like element via thin-walled, plastic webs or a plastic film that are easy to tear off. A tamper-proof seal of this kind is disadvantageous because, being easy to tear off, these webs can also be detached unintentionally, thus indicating opening that has not in fact taken place. In addition, the intended indication of previous opening is also not necessarily unequivocal. If, for example, the cover is placed back onto the container after being raised, and the tongue-like element returned to its starting position, it may be that the webs still remaining on at least one end of the edges more likely suggest that the container has not yet been opened.

On a container disclosed in EP 1 052 183 A1, a tongue-like element connected to the container likewise serves to raise the cover. When in its starting position, sections of the tongue-like element are overlapped, without engaging, by one or more web-like elements, these elements being designed to break open or be deformed when the tongue-like element is moved away from its starting position in order to open the container. However, it can happen in this context that, after subsequent re-closing, when the tongue-like element is again in its starting position, the element or elements is or are likewise back in their original position, i.e. come to rest on the tongue-like element, meaning that indication of the previous opening of the container is not guaranteed. At the same time, the web-like elements overlapping the tongue-like element are also susceptible to being damaged or torn off, e.g. during transport, this again meaning that opening of the container would be indicated without actually having taken place.

SUMMARY

Therefore, the object of the invention is to create a container with a device for raising the cover located on the container, which is easy and inexpensive to manufacture and displays a device that is capable of unequivocally indicating previous opening of the container.

According to the invention, the object is solved in that the tongue-like element engages the container edge from behind with at least one part of the tongue-like element, the part of the tongue-like element can be guided outwards, in front of the container edge, by the pivoting movement, and the part of the tongue-like element cannot be guided back behind the container edge when the tongue-like element is pivoted back towards the starting position.

The part of the tongue-like element engaging the container edge from behind initially ensures that no parts of the tongue-like element project unfavourably from the container, and also that no parts designed to be deformed, torn off or broken open are exposed to the risk of being damaged prior to first-time use as intended. During the pivoting movement to be performed in order to raise the cover, the part of the tongue-like element engaging the container edge from behind is guided outwards, in front of the container edge. This provides a visible indication that makes it unequivocally clear whether or not the container has already been opened at some time, in that the part of the tongue-like element previously covered by an area of the container edge is suddenly visible to the user. In this context, the part of the tongue-like element is designed in such a way that pivoting the tongue-like element back, or replacing the cover after opening the container, does not lead to a situation where the part of the tongue-like element can be guided back behind the container edge. Rather, the part of the tongue-like element comes to rest on the container edge during this movement, mechanically opposing the return movement. In this context, a further indication of prior use is that the tongue-like element itself can no longer be completely returned to its starting position and stands a certain distance off from the wall of the container, this not affecting the fact that re-closing of the container by means of the cover is, of course, still possible. Finally, the design of the part of the tongue-like element to some extent also permits unintentional movement of the tongue-like element, without this impairing the information to be communicated, in which context the tongue-like element is at the same time protected against accidental damage.

In a preferred embodiment, the part of the tongue-like element is designed as an integral part of the tongue-like element. It is easy to manufacture as a result, there being no need to provide additional moulds or subsequent moulding-on operations. In turn, the tongue-like element is accommodated in an opening left in the peripheral container edge, its radial extension essentially corresponding to that of the remainder of the container edge. Although not subject to any restrictions in terms of shape, it is often of rectangular or trapezoidal design.

The part of the tongue-like element can preferably be deformed or broken open during the pivoting movement of the tongue-like element. In this way, the part of the tongue-like element can be guided outwards, past the comparatively rigid edge areas of the container, during the pivoting movement. When the tongue-like element is pivoted back, the part(s) of the tongue-like element then come to rest from the outside on the edge areas that previously covered them, meaning that they are then positioned between the container edge and the side of the tongue-like element facing this edge, as a result of which the pivoting movement of the tongue-like element towards the starting position is impeded and complete pivoting back is prevented, especially when replacing the cover. Both the part(s) of the tongue-like element lying on the container edge, and also the position of the tongue-like element itself, are thus visible as an indication of previous opening of the container.

In a preferred embodiment of the container according to the invention, the container edge displays, in the region of the tongue-like element, a downward-pointing edge projection that engages a recess in the tongue-like element. In this context, the essentially random contour of this downward-pointing edge projection adapts to the recess provided in the tongue-like element, clearance being provided between the edge projection and the tongue-like element. As a result, when performing the pivoting movement, which takes place via a hinge, the tongue-like element can be pivoted away from the edge projection, meaning that the edge projection disengages from the recess. In this context, the edge projection is preferably provided with a tongue that is engaged by the part of the tongue-like element from behind. This tongue is of curved, forward-projecting design. Consequently, the part of the tongue-like element located in the region of the recess is overlapped by the tongue located on the edge projection, meaning that the latter does not itself engage the recess in the tongue-like element. The pivoting movement of the tongue-like element leads to the part of the tongue-like element acting on the side of the tongue facing the container wall, this causing deformation of the part of the tongue-like element towards the container wall. The rest of the tongue-like element then pulls the part of the tongue-like element past the tongue, meaning that the part of the tongue-like element moves to the side of the tongue facing away from the container wall. The length and shape of the tongue now prevent the part of the tongue-like element from being moved back behind the tongue in the opposite direction.

To facilitate the raising of the cover brought about by the tongue-like element, provision can be made in a further preferred embodiment for a predetermined breaking line to be located in the area of the tongue-like element engaging the tongue from behind. When the part of the tongue-like element acts on the edge projection or the tongue, the material of the part of the tongue-like element partly breaks open, meaning that less force has to be applied to perform the pivoting movement. In this embodiment, a corresponding design of the edge projection or the tongue again ensures that it is not possible to guide the part of the tongue-like element back behind the edge area which it previously engaged from behind.

In an advantageous embodiment, webs partially overlapping the recess are located on the side of the tongue-like element facing the container wall as parts of the tongue-like element between the edge projection and the container wall. These webs are, for example, of beam-like design and connected to the tongue-like element at one or more points in the edge area of the recess. During the pivoting movement of the tongue-like element, they act on the side of the edge projection facing the container wall and are initially bent back towards the container wall, before subsequently being guided forwards, past the edge projection and through the clearance between the edge projection and the tongue-like element. When pivoting the tongue-like element back, the webs can then no longer be threaded back through and come to rest on the outside of the edge projection. As a result, the tongue-like element can again not return to its starting position.

To protect the tongue-like element against unintentional operation, it can also be advantageous to provide for the tongue-like element to be connected to the edge projection by breakable links. These bridge the clearance between the tongue-like element and the edge projection at certain points and prevent movement of the tongue-like element relative to the rest of the container. The links can then easily be detached during first-time operation of the tongue-like element in the process of raising the cover. In a further development, the tongue-like element can, for example, also be connected to the container edge by breakable links to provide additional protection against unintentional operation of the tongue-like element.

In a further advantageous embodiment of the container according to the invention, parts of the tongue-like element are provided on the lateral ends of the tongue-like element, which engage the respective lateral ends of the container edge facing the tongue-like element from behind. These parts of the tongue-like element can initially likewise be designed in the form of beam-like webs, which engage the container edge opposite the lateral ends of the tongue-like element from behind at individual points. In addition, however, an embodiment of the parts of the tongue-like element is also conceivable where, for example, the parts initially run perpendicular to the container wall in the manner of wings or louvres and are then angled, engaging the container edge from behind over part or all of the height of the tongue-like element. In this context, the mode of action of such parts of the tongue-like element in the form of louvres during the pivoting movements is in principle identical to that of the webs. This also makes it apparent that a host of possible varieties appears conceivable as regards the parts of the tongue-like element engaging the edge projection or the lateral edge of the container from behind.

Moreover, it is advantageous to provide ribs between the side of the tongue-like element facing the container wall and the container wall to impede a pivoting movement towards the container wall. This additionally ensures that any attempt to get the tongue-like element into its starting position by force when pivoting it back will be unsuccessful. Furthermore, the tongue-like element can be additionally stiffened and stabilised by these ribs.

For the purpose of providing additional safety during transport, it is advantageous in a further embodiment for the downward-facing edge side of the tongue-like element to stand back relative to the lower end of the container edge drawn downwards on the container wall. This caters to the fact that tilting movements and skewing can occur during transport, meaning that this measure attempts to prevent unintentional operation of the tongue-like element and the associated raising of the cover by impeding intervention on the tongue-like element.

It is furthermore advantageous for the tongue-like element on a container according to the invention to display at least one operating hole for performing the pivoting movement. This facilitates the intended use of the tongue-like element, since the person using it is given a hole for the hand performing the pivoting movement of the tongue-like element, or its fingers, and can perform the movement easily and reliably as a result.

Moreover, it is advantageous in a further development for the side of the tongue-like element facing away from the container wall to display a textured surface. This can prevent slipping of the area of the hand of a user that comes into contact with this surface when operating the tongue-like element, meaning that the surface provided with ribs, for example, benefits safe handling of the container.

In a further advantageous embodiment, at least one part of the tongue-like element located on the tongue-like element displays a mark that is at least partly covered by an area of the container edge when the tongue-like element is in its starting position. The mark can comprise both lettering and a coloured marking, where, for example, it would be conceivable to design the part of the tongue-like element in a different colour than the container in order to ensure greater attention of an observer to the part of the tongue-like element, which is then completely visible after opening. The mark is, however, not limited to this kind of marking. Rather, further, very different types of marking are also conceivable.

BRIEF DESCRIPTION OF THE DRAWINGS

The invention is described in more detail below on the basis of several practical examples. The associated drawings show the following.

DETAILED DESCRIPTION

Figure 1:
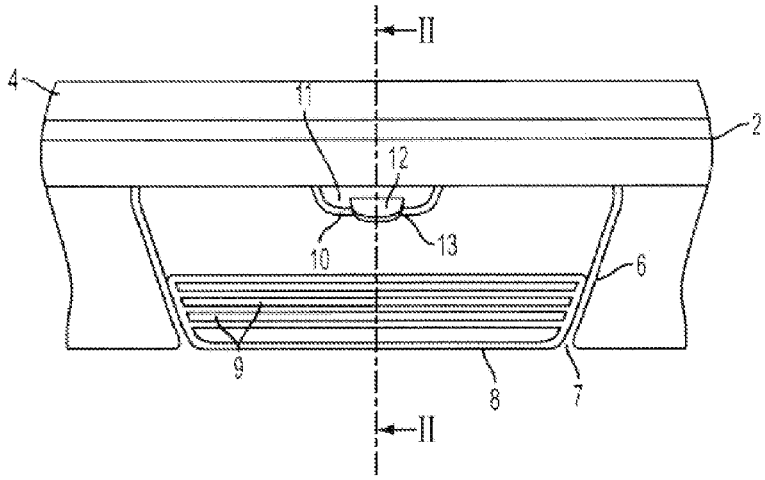
FIG. 1 A front view of the edge area of a first embodiment of the container according to the invention, with a tongue-like element, FIGS. 2, 3 A sectional view of the container in FIG. 1 along Line II-II, with the cover in place and the tongue-like element in its starting position and in its pivoted position, FIG. 4 A perspective front view of a further embodiment of the container, with container edge, tongue-like element and edge projection, as well as webs engaging the lateral edge of the container as the parts of the tongue-like element, FIG. 5 A view of the edge area of a further embodiment from below, with webs engaging the edge projection from behind and louvre-like parts of the tongue-like element that engage the lateral edge from behind, FIGS. 6, 7 Front views of two further embodiments of the tongue-like element, with operating holes, and FIGS. 8, 9 Front views of a further embodiment with the tongue-like element in its starting position and in its pivoted position.

FIG. 1 shows a front view of an area of peripheral container edge 2 of container 1, made of a thermoplastic material, without cover 3. Starting from the invisible container opening at the upper end of container edge 2 and flange 4 located there, container edge 2 extends downwards along container wall 5. Between two lateral edges 6 of container edge 2, an opening 7 is provided that is open towards the bottom and into which tongue-like element 8, connected to the container edge, fits in its starting position, at a distance from the lateral edges. The plane cross-section of tongue-like element 8, the side of which facing the observer is provided with ribs 9, tapers in the downward direction, while the downward-facing edges of tongue-like element 8, which can in principle be of any desired shape, and of lateral edges 6 end at the same level. In this context, ribs 9 can be provided both to prevent slipping and also for stiffening tongue-like element 8.

In the middle of the upward-facing edge area of tongue-like element 8 is recess 10, which is engaged by downward-facing edge projection 11, which tapers slightly in this direction and protrudes from container edge 2. Located on edge projection 11, and leading down from it and away from the container at an angle, is tongue 12, which overlaps the part of the tongue-like element 13, which is opposite edge projection 11 and located on tongue-like element 8. A pivoting movement of tongue-like element 8 towards the observer guides the part of the tongue-like element 13 past tongue 12, meaning that the part of the tongue-like element 13 previously covered by tongue 12 is then visible, whereas its invisible rear side is then opposite tongue 12 and, owing to the shape and arrangement of tongue 12, can not be guided back past it.

Figure 2:
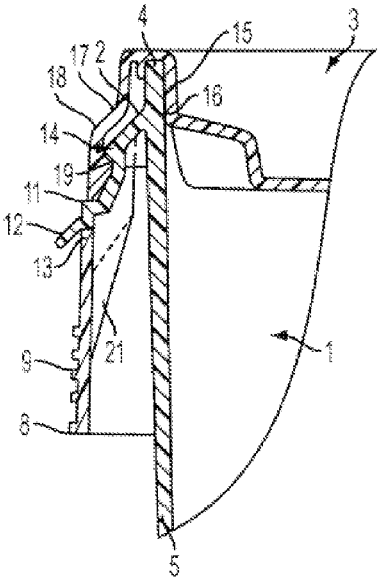
Figure 3:
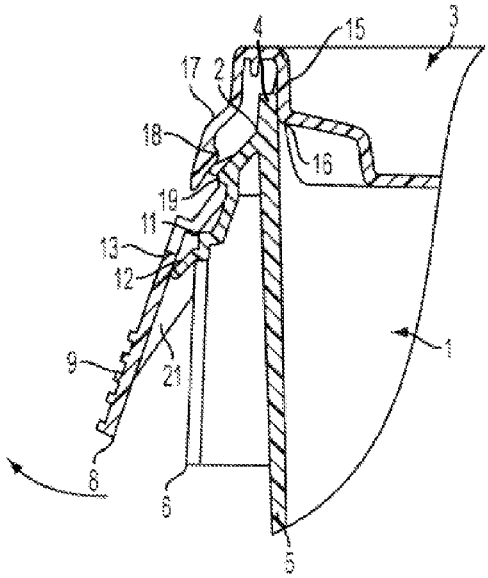

FIGS. 2 and 3 show a sectional view of edge area 1 of the container in FIG. 1 along Line II-II, with cover 3 in place. In FIG. 2, tongue-like element 8 is initially in its starting position. It can likewise be seen that cover 3 is detachably connected to the edge area of the container via flange 4 and snap-fit device 14. In this context, peripheral inner edge 15 of the cover sits on inner wall 16 of container 1 in sealing fashion in the area of flange 4. Outer edge 17 of the cover is designed with inward-protruding projection 18 in such a way that it forms snap-fit device 14 together with protruding nose 19 of container edge 2. The underside of outer edge 17 is supported on edge projection 11 of container edge 2 and on tongue-like element 8. In addition, reinforcing ribs 21 are also integrally moulded on the inner side of tongue-like element 8 with the aim of impeding pivoting movement of tongue-like element 8 towards container wall 5.

FIG. 3 shows tongue-like element 8, connected to container edge 2, after a pivoting movement to be performed in the direction of the arrow has taken place. During the pivoting movement, the part of the tongue-like element 13 located on tongue-like element 8 acts on tongue 12, initially pressing it in an upward direction, together with edge projection 11. In this process, snap-in device 14 disengages, projection 18 of outer edge 17 of cover 3 being moved past nose 19 of container edge 2 and coming to rest on its upward-facing side. At the same time, inner edge 15 of cover 3 slides upwards on the inner wall of the container, still forming a seal. Cover 3 can subsequently be easily released from container 1. When the pivoting movement is continued, the part of the tongue-like element 13 is finally guided past tongue 12, meaning that the sides of the part of the tongue-like element 13 and of tongue-like element 8 facing container wall 2 are opposite the tongue. The pivoting movement of tongue-like element 8 gives a free view of lateral edge 6, which was previously hidden in FIG. 2. It can also be seen from FIG. 3 that the shape and arrangement of edge projection 11 and tongue 12 prevent pivoting of tongue-like element 8 back into its starting position, this movement causing the rear side of the part of the tongue-like element 13 and of tongue-like element 8 to come to rest on the outer side of tongue 12.

Figure 4:
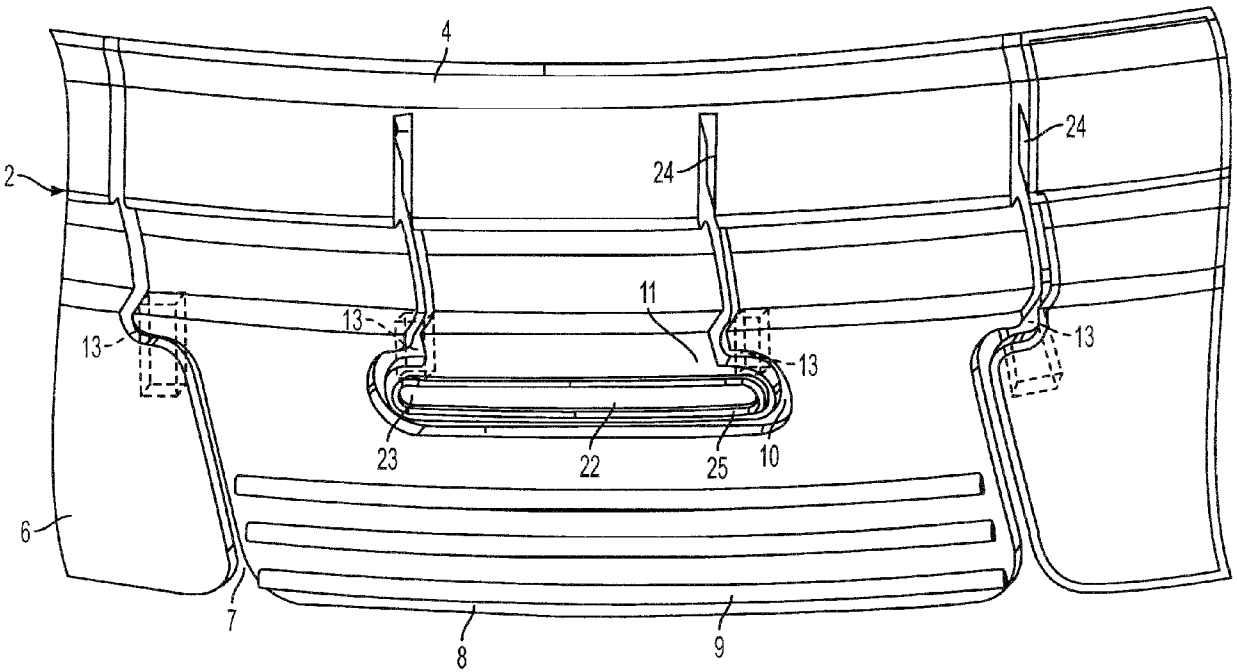

In principle, the further embodiment presented in a perspective front view in FIG. 4 shows an area of container edge 2 without cover 3, similar to the illustration in FIG. 1. Here, container edge 2 is provided, on both lateral ends of tongue-like element 8 and in the area of edge projection 11, with axial interruptions 24, which continue in the axial direction into opening 7 between lateral edges 6 and recess 10 of tongue-like element 8. Interruptions 24 permit independent movement of tongue-like element 8 relative to edge projection 11 and lateral edges 6.

Again, tongue-like element 8, accommodated by opening 7, can be seen in its starting position. In this case, however, the lateral ends of tongue-like element 8 run parallel to lateral edges 6, which are arranged in a perpendicular direction, meaning that tongue-like element 8 does not taper in the downward direction. Again, edge projection 11 protrudes into recess 10, located centrally in the upper edge area of tongue-like element 8. Rectangular strip element 22 with semi-circular end pieces 23 is integrally moulded on the end of edge projection 11 facing tongue-like element 8, the edges of strip element 22 and end pieces 23 lying opposite the edges of recess 10 at a distance. For stabilisation, stiffening web 25 is provided on the outer side facing away from container wall 5, partly covering strip element 22 and end pieces 23. On the side of tongue-like element 8 facing away from the observer, parts of the tongue-like element 13 are integrally moulded in the form of webs between tongue-like element 8 and container wall 5, partly overlapping recess 10 and thus engaging strip element 22 and end pieces from behind. In the same way, at the two ends of the tongue-like element facing lateral edges 6, lateral edges 6 are each engaged from behind by longitudinal webs provided on the tongue-like element there as parts of the tongue-like element 13. During the pivoting movement taking place when opening, the parts of the tongue-like element 13 act on the sides of the rigid strip elements/end pieces, or of the rigid lateral edge, facing the container wall, are pivoted and simultaneously deformed, and guided past the rigid parts towards the front. Once they have passed the obstacles, the elasticity of the material causes them to essentially resume their previous, integrally moulded position on tongue-like element 8. In this way, when the tongue-like element is pivoted back, they come to rest on the outer side of those parts of the edge of container 1 that they were previously guided past. To improve handling, the top side of tongue-like element 8 is again provided with ribs 9 in this embodiment.

Figure 5:
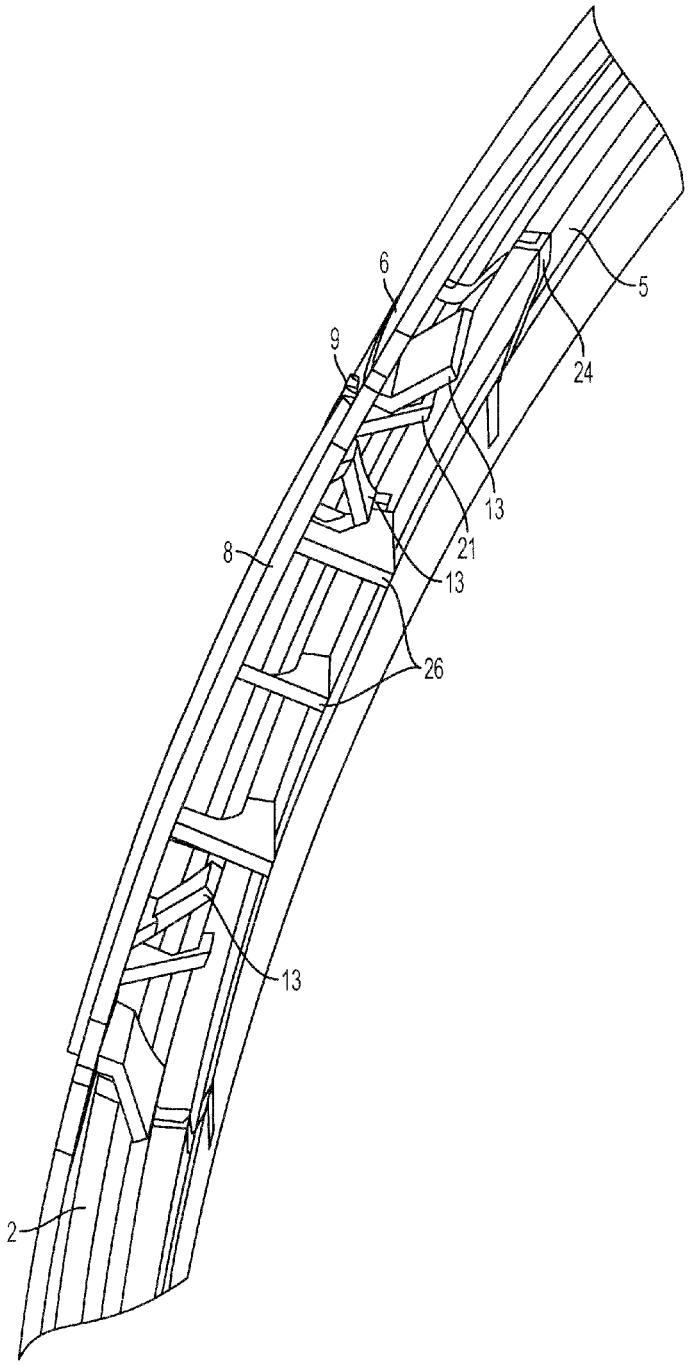

FIG. 5 shows a perspective bottom view of the edge area of a further embodiment. Peripheral container edge 2 with lateral edges 6 can initially be seen in this figure. Opening 7, which is located between lateral edges 6, continues into interruptions 24. Located between lateral edges 6 is tongue-like element 8, the lower edge and ribs 9 of which can be seen. Wing or louvre-like parts of the tongue-like element 13 are integrally moulded on the two lateral ends of tongue-like element 8. These engage lateral edges 6 from behind in that they initially protrude perpendicularly from tongue-like element 8 towards container wall 5 and then at an angle towards the lateral edges. In this context, the parts of the tongue-like element 13 extend in the perpendicular direction from the lower edge of tongue-like element 8 over the length of the edge of the tongue-like element opposite lateral edge 6.

More towards the centre of tongue-like element 8, reinforcing ribs 21 are provided on the rear side of the tongue-like element to promote stability, alongside the parts of the tongue-like element 13. Even farther towards the centre of tongue-like element 8, there then follow further parts of the tongue-like element 13, which are designed to be guided past edge projection 11 (not shown). These parts of the tongue-like element 13 again display an area pointing perpendicularly towards container wall 5 and an angled area which, however, points away from lateral edges 6 in this case. Between the ends of these parts of the tongue-like element 13 are three domes 26, located on container wall 5 and projecting perpendicularly from it. The rear side of container edge 2 extends between these domes 26, which are provided for reinforcement and stiffening, while edge projection 11 (not shown) is located on their top side. Therefore, in this embodiment, the parts of the tongue-like element 13 are again guided past both the edge projection and the lateral edges during the pivoting movement. In this context, the design of the parts of the tongue-like element 13, with a section perpendicular to container wall 5 and a section angled relative to it, is particularly favourable for resiliently opposing any attempt to move tongue-like element 8 back towards its starting position. During this movement, the parts of the tongue-like element 13 come to rest on the outer side of the edge areas that they previously engaged from behind, meaning that the tongue-like element stands out at an angle relative to the rest of container edge 2.

Figure 6:
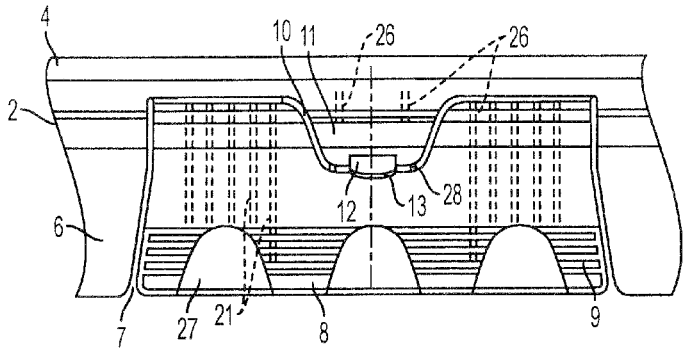
Figure 7:
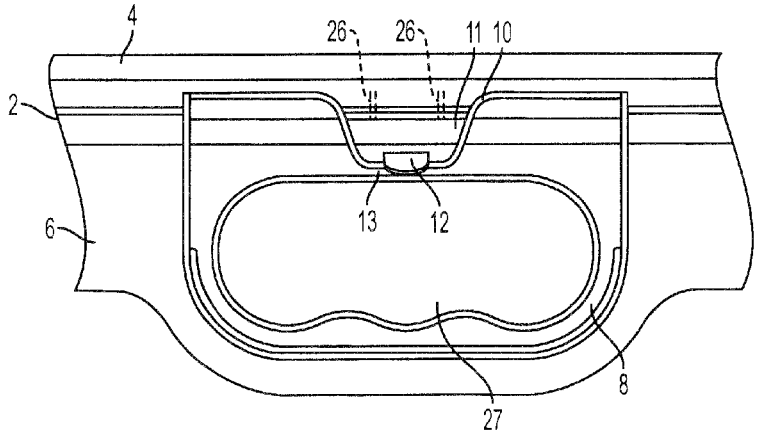

FIGS. 6 and 7 show two further embodiments of tongue-like element 8, where the functional principle of the tongue-like element essentially corresponds to that in FIG. 1, although the end of tongue-like element 8 itself facing container edge is drawn farther into container edge 2, meaning that a generally larger edge projection 11 is obtained. Tongue-like element 8, which tapers in the upward direction up to container edge 2 in the case of FIG. 6, displays several operating holes 27 at its lower edge, into which a user can insert his fingers to perform the pivoting movement. Furthermore, reinforcing ribs 21, indicated by broken lines, are integrally moulded on the side of the tongue-like element facing the container wall. Also shown as broken lines on the side of edge projection 11 facing container wall 5 are domes 26, which are integrally moulded there. In addition, edge projection 11 in FIG. 6 is connected to tongue-like element 8 by breakable links 28 in the form of connecting webs in order to protect tongue-like element 8 against unintentional operation.

In FIG. 7, opening 7 with associated tongue-like element 8 is located within container edge 2, meaning that no opening 7 that is open towards the bottom and bordered by lateral edges 6 is formed. The largest part of tongue-like element 8 in terms of area is taken up by the single operating hole 27, into which several fingers of an operating hand can be inserted simultaneously to perform the pivoting movement of the tongue-like element.

Figure 8:
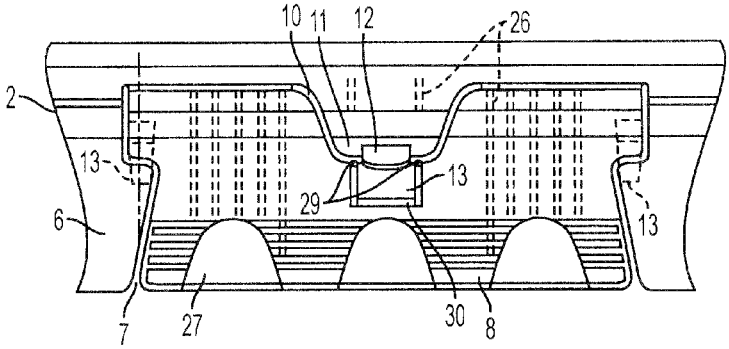
Figure 9:
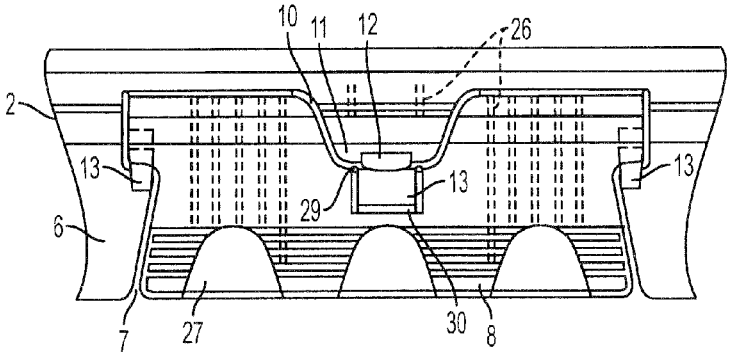

Finally, FIGS. 8 and 9 show two different positions of tongue-like element 8 of a further embodiment, namely the starting position and the pivoted position of tongue-like element 8. In this context, the arrangement of domes 26, located between container wall 5 and tongue-like element 8, corresponds to the illustration in FIG. 6. The part of the tongue-like element 13 located centrally on tongue-like element 8 displays essentially vertical, free lateral ends opposite the edges of tongue-like element 8, which are connected to the latter by breakable links 29. In this context, the part of the tongue-like element 13 is covered by tongue 12 and is connected in pivoting fashion to tongue-like element 8 via area of thinner material 30 at its end facing operating holes 27. Furthermore, located on the ends of tongue-like element 8 facing lateral edges 6 are parts of the tongue-like element 13, which initially engage lateral edges 6 in FIG. 8 from behind. After reaching into operating holes 27, pivoting of tongue-like element 8 out of the plane shown in the figure towards the observer results in links 29 breaking and in both part of the tongue-like element 13 located in the centre of tongue-like element 8 and also parts of the tongue-like element 13 engaging lateral edges 6 from behind being guided forwards. During the pivoting movement, the centrally located part of the tongue-like element initially comes into contact with tongue 12 from behind and, following breaking of links 29, is pivoted towards container wall 5, area of thinner material 30 serving as the pivoting axis in this context. Following the pivoting movement and corresponding raising of cover 3 (not shown), the situation illustrated in FIG. 9 results. It can be seen there that the part of the tongue-like element 13 that pivots about area of thinner material 30 has been guided past tongue 12, residues of now broken links 29 remaining either on the part of the tongue-like element 13 itself, or on tongue-like element 8, or on both, while the lateral parts of the tongue-like element were guided past the lateral edges. Complete pivoting back of tongue-like element 8 is prevented by the fact that the central part of the tongue-like element 13 comes to rest on tongue 12 and the lateral parts of the tongue-like element 13 comes to rest on lateral edge 6, meaning that tongue-like element 8 stands off from its starting position at a certain angle.

LIST OF REFERENCE NUMBERS

1 Container
2 Container edge
3 Cover
4 Flange
5 Container wall
6 Lateral edge
7 Opening
8 Tongue-like element
9 Rib
10 Recess
11 Edge projection
12 Tongue
13 Part of the tongue-like element
14 Snap-fit device
15 Inner edge of the cover
16 Inner wall
17 Outer edge of the cover
18 Projection
19 Nose
21 Reinforcing rib
22 Strip element
23 Semi-circular end piece
24 Interruption
25 Stiffening web
26 Dome
27 Operating hole
28 Breakable links
29 Breakable links
30 Area of thinner material

What is claimed is:

1. A container indicator system comprising:
a container comprising:
a sidewall;
a top opening; and
a peripheral flange surrounding said top opening, said peripheral flange comprising:
a rim, and
a skirt extending downward from said rim and spaced circumferentially around said sidewall, said skirt having a rear portion and an opening in said skirt, said opening in said skirt arranged between two lateral edges of said skirt;
a pivotal tab disposed within said opening in said skirt and connected to said peripheral flange, said pivotal tab having two lateral ends which extend parallel with the two lateral edges of the skirt; and
a cover for closing said top opening of the container, said cover detachable between:
an initial closed position wherein said cover is detachably connected to said container, said pivotal tab supports said cover, and at least one part of said skirt overlaps at least one part of said pivotal tab such that said at least one part of said pivotal tab is not visible to a user;
an open position wherein, after a pivoting movement of the pivotal tab during which said at least one part of said pivotal tab is guided outwards from behind said at least one part of said skirt, said at least one part of said pivotal tab is disposed in front of said at least one part of said skirt such that said skirt is not broken and said at least one part of said pivotal tab is visible to a user; and
a subsequent closed position wherein said at least one part of said pivotal tab is prevented from being disposed behind said at least one part of said skirt;
wherein said at least one part of said pivotal tab is provided on at least one of the lateral ends of the pivotal tab;
wherein said at least one part of said pivotal tab is provided with an elasticity and said at least one part of said skirt is provided with a rigidity such that said at least one part of the pivotal tab is guided outwards from behind said at least one part of said skirt without breaking said at least one part of said skirt; and
wherein the pivotal tab has a lower end which is not covered by the skirt when the cover is in the initial closed position.

2. The container indicator system according to claim 1, characterised in that said at least one part of said pivotal tab is designed as an integral part of said pivotal tab.

3. The container indicator system according to claim 1, characterised in that said at least one part of said pivotal tab is deformed or broken open during a pivoting movement of said pivotal tab.

4. The container indicator system according to claim 1, characterized in that an edge projection is provided with a tongue that is engaged by said at least one part of said pivotal tab from behind.

5. The container indicator system according to claim 1, characterised in that an edge projection is provided with a tongue that is engaged by said pivotal tab from behind and a predetermined breaking line is located in an area of said pivotal tab engaging said tongue from behind.

6. The container indicator system according to claim 1, characterised in that said pivotal tab is connected to a container edge by breakable links.

7. The container indicator system according to claim 1, characterised in that said at least one part of said pivotal tab engages said skirt from behind said skirt.

8. The container indicator system according to claim 1, characterised in that ribs are provided between a side of said pivotal tab facing said container sidewall to impede a pivoting movement towards said sidewall.

9. The container indicator system according to claim 1, characterised in that a downward-facing edge side of said pivotal tab stands back relative to a lower end of a container edge drawn downwards on said sidewall.

10. The container indicator system according to claim 1, characterised in that said pivotal tab displays at least one operating hole for performing the pivoting movement.

11. The container indicator system according to claim 1, characterised in that a side of said pivotal tab facing away from said sidewall displays a textured surface.

12. The container indicator system according to claim 1, characterised in that said at least one part of said pivotal tab displays a mark that is at least partly covered by an area of a container edge when said pivotal tab is in a starting position.

* * * * *